US008776404B2

(12) United States Patent
Wanlass

(10) Patent No.: US 8,776,404 B2
(45) Date of Patent: Jul. 15, 2014

(54) PLOW ROTATION ACTUATOR

(75) Inventor: Bert Wanlass, Woodland Hills, UT (US)

(73) Assignee: Auto-Vation Inc., Woodland Hills, UT (US)

( * ) Notice: Subject to any disclaimer, the term of this patent is extended or adjusted under 35 U.S.C. 154(b) by 390 days.

(21) Appl. No.: 13/161,299

(22) Filed: Jun. 15, 2011

(65) Prior Publication Data

US 2011/0303426 A1 Dec. 15, 2011

Related U.S. Application Data

(60) Provisional application No. 61/355,008, filed on Jun. 15, 2010.

(51) Int. Cl.
*E01H 5/00* (2006.01)

(52) U.S. Cl.
USPC ..... 37/196

(58) Field of Classification Search
USPC ..... 37/231–235, 264, 266, 196, 197; 74/89.11, 109, 120, 422, 425, 89.15; 172/818–820; 296/57.1, 106, 146.4
See application file for complete search history.

(56) References Cited

U.S. PATENT DOCUMENTS

| | | | | |
|---|---|---|---|---|
| 2,854,766 | A * | 10/1958 | Miller | 37/283 |
| 5,449,212 | A * | 9/1995 | Seifert | 296/57.1 |
| 6,957,505 | B1 * | 10/2005 | Moffitt | 37/231 |
| 7,252,278 | B2 * | 8/2007 | Garrido | 248/424 |
| 7,419,011 | B2 * | 9/2008 | Curtis et al. | 172/820 |

* cited by examiner

*Primary Examiner* — Robert Pezzuto
(74) *Attorney, Agent, or Firm* — Tope-McKay & Associates

(57) ABSTRACT

Described is a snow and debris removal system containing both lift and rotational actuators. The actuators allow for both up and down and rotational movement relative to the implement mounting device the removal system is attached to. The rotational movement is provided by a rotation actuator fixed to a frame which applies force to a cable via a worm. The cable is mounted to an implement causing the implement to rotate about a pivot point attached to the frame. Rotational forces incurred on the implement go from the cable to the nut to the worm which does not back-drive thereby, avoiding damage to the motor actuator. Up and down movement is provided by an actuator that is mounted to the frame of the debris removal system which drives a rack which is attached to a fixed point on the implement mounting device.

16 Claims, 8 Drawing Sheets

PLOW ROTATION ACTUATOR

PRIORITY CLAIM

This is a non-provisional application of U.S. Provisional Application No. 61/355,008, filed in the United States on Jun. 15, 2011, titled, "PLOW LIFT AND ROTATION ACTUATOR."

BACKGROUND OF THE INVENTION (1) Field of Invention

The present invention relates to debris and snow removal systems and, more particularly, to position actuators for debris and snow removal systems mounted on vehicles.

(2) Description of Related Art

Implement position actuators have long been known in the art. The size and weight of the vehicle to which the implement is mounted typically limits the size and weight of the implement position actuator. On large vehicles, electric and hydraulic actuators are typical. On smaller vehicles however, like All Terrain Vehicles (ATV's) and light trucks, hydraulic actuators are often too heavy and or bulky because of the requirement of an additional subsystem to handle hydraulic fluids. Correspondingly, the field of small vehicle implement position actuators is dominated by electrical position actuators.

Mainstream electrical position actuators have certain distinct advantages and disadvantages. Their greatest advantage is that most small vehicles already have an electrical system. Further, electric motors are often quite compact. Their greatest disadvantage with respect to implement position actuators is their relatively high RPM and low torque. All current electrical actuator systems on the market are forced to use some sort of gear reduction system to provide the high torque needed for implement position actuation. All leading systems currently on the market rely on bulky and complicated multistage gear assemblies. These assemblies are relatively difficult and expensive to manufacture.

Another problem with the related art is the need to isolate the implement position actuator from shocks the implement sustains. In typical operation, an implement can hit rocks and other solid objects and the force of those impacts are transferred from the implement through the implement position actuators to the vehicle the system is mounted on. The implement position actuator is typically the weakest portion of the vehicle implement system and it usually absorbs the majority of the forces from an impact. When the actuator absorbs the force it reduces the shocks transferred to the vehicle. However, the implement position actuator must be robust enough to handle the energy that will be transferred through it and not destroy itself. This is a common problem with the related art in that it is difficult to design a gear assembly that isolates the shocks sustained by the implement and does not suffer from reduced lifespan.

Thus, a continuing need exists for an electrically operated implement position actuator that is simple to manufacture and isolates the vehicle from the shocks and forces the implement will encounter while providing a long unit lifespan.

SUMMARY OF INVENTION

The present invention relates to an implement position actuator. The implement position actuator is composed of a channel that contains a worm. The worm is threaded and has a drive shaft attached to it. It is mounted in the channel in a way that allows it to freely rotate.

A threaded nut is threadedly engaged with the worm. The exterior of the nut is shaped and the channel is sized in a way that allows the nut to reside within the channel and simultaneously prevent rotation of the nut when the worm is turned. So, when the worm is turned, the nut, prevented from rotating within the channel by the channel interior, instead slides up or down the worm, depending on the direction of worm rotation.

A driveshaft is attached to the worm in a way that does not interfere with the travel of the nut in the channel. A motor is attached to the driveshaft. The driveshaft in some aspects can be flexible.

A cable is attached to the nut. The cable extends out of the channel past either end of the worm. So, when the driveshaft rotates the worm, the nut travels up or down the worm in the channel pulling the cable along with it.

In another aspect, the implement position actuator has two roller thrust bearings rotationally mounted with the worm on either end of the worm. Versions of the implement position actuator that contain these roller thrust bearings have a worm lead angle of 6 to 15.6 degrees.

In a different aspect, the implement position actuator also includes two hardened and ground thrust washers. These are rotationally mounted with the worm on either end of the worm. Versions of the rotation actuator that contain these hardened and ground thrust washers have a worm lead angle of 13 to 19 degrees.

In another aspect, the present invention's motor is an electric motor that has electrical leads. The motor must be the sort that resists rotation when the leads are grounded.

In yet another aspect, the channel almost entirely encloses the worm and nut. But it does contain at least two holes, one at each end through which the ends of the cable extend.

In another aspect, the implement position actuator also includes a frame with a pivot point in the front and a pulley in the back. An implement to be rotated is attached to the pivot point. One end of the cable is attached to one side of the implement and the other end of the cable is extended around the pulley and attached to the other side of the implement. So, each end of the cable is attached to a side of the implement with the pivot point residing between the two cable connection points. In operation, the electric motor via the driveshaft turns the worm. This causes the nut to slide up and down the channel thereby extending one end of the cable and retracting the other. Because one end of the cable is attached to one side of the implement and the other end of the cable is attached to the other side, this combination of extending the cable on one end and retracting it on another forces the implement to rotate about the pivot point.

In yet another aspect of the implement position actuator, the rotational axis of the pulley and the rotational axis of the implement pivot point are parallel.

In another aspect, the back portion of the frame has a mounting slot where the pulley resides.

In yet another aspect, the mounting slot is formed so that it is similar in shape and size to the pulley and cable.

In another aspect, the implement is either a plow, rock rake, box blade, grader blade, or hay rake.

In another aspect of the invention the implement position actuator contains a rack and pinion which is engaged with one another. The pinion is mounted to a case in a way that allows it to freely rotate. A motor actuator is coupled to the pinion and a lift point is attached to the rack. So, when the motor rotates the pinion the rack moves and thus either extends or retracts the lift point.

In yet another aspect, the actuator has an implement and an implement mounting device. The implement and implement mounting device are attached in a way that allows the implement to move relative to the implement mounting device.

In another aspect of the invention the implement mounting devices has some sort of fixed point. And either the case is attached to the fixed point and the lift point is attached to the implement, or the case is attached to the implement and the lift point is attached to the fixed point. In this way, when the motor rotates the pinion and either extends or retracts the rack it moves the implement relative to the implement mounting device.

In yet another aspect of the implement position actuator, the implement is attached to the implement mounting devices by means of a hinge.

In another aspect of the invention the case encloses most of the rack.

In yet another aspect, a protective cover is attached to the case and the lift point so that the portion of the rack or lift point that extends out of the case is protected.

In another aspect, the motor is attached to the case.

In yet another aspect of the implement position actuator the motor actuator is connected to the pinion by a worm and worm gear. So, when the motor actuator turns, it rotates the worm which turns the worm gear thereby rotating the attached pinion.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
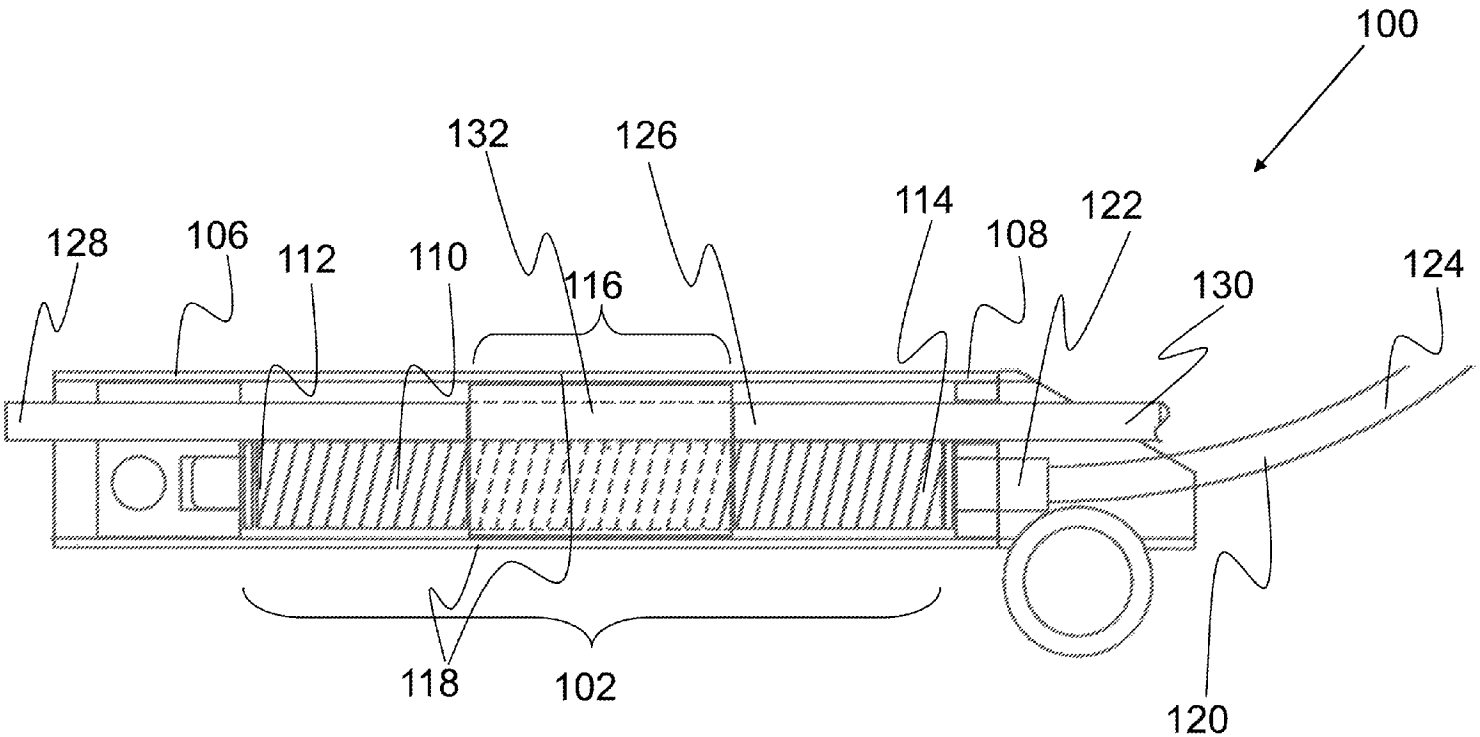
FIG. 1 is a top-view illustration of a rotation actuator incorporated in the snow or debris removal system.

The present invention relates to debris and snow removal systems, and more particularly, to position actuators for debris and snow removal systems mounted on vehicles. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Note, if used, the labels left, right, front, back, top, bottom, forward, reverse, clockwise and counter-clockwise have been used for convenience only and are not intended to imply any particular fixed direction. Instead, they are used to reflect relative locations and/or directions between various portions of an object. As such, as the implement position actuator is turned around and/or over, the above labels may change their relative configurations.

Before describing the invention in detail, an introduction is provided to provide the reader with a general understanding of the present invention. Next, a detailed description of various aspects of the present invention is provided to give an understanding of the specific details (1) Introduction The present invention relates to snow and debris removal systems and the implement position actuators attached thereto. The debris removal system includes two separate implement position actuators that allow for both up and down and rotational movement relative to the implement mounting device the removal system is attached to. The rotational movement is provided by an actuator fixed to a frame which applies force to a cable via a worm. The cable is mounted to an implement causing the implement to rotate about a pivot point attached to the frame. When the implement encounters an obstruction it applies a rotational force to the implement. This force goes from the cable to the nut to the worm which does not back-drive thereby, avoiding damage to the motor actuator and its flexible drive cable. Up and down movement is provided by an actuator that is mounted to the frame of the debris removal system which drives a rack which is attached to a fixed point on the implement mounting device.

(2.1) Detailed Description of the Snow and Debris Removal System

The present invention relates to a snow and debris removal system. FIG. 1 illustrates a top-view of the rotation actuator 100 in the snow and debris removal system. As a non-limiting example the rotation actuator 100 includes a channel 102 having a channel wall 118, a left end 106 and a right end 108. Additionally, the rotation actuator 100 includes a worm 110 having threads, a left end 112, and a right end 114. The worm 110 is rotationally mounted in the channel 102 such that the right end 114 of the worm 110 is proximate to the right end 108 of the channel 102 and the left end 112 of the worm 110 is proximate to the left end 106 of the channel 102. Further, the rotation actuator 100 includes a nut having internal threads 116, threadedly engaging the worm threads. The nut 116 has an exterior surface formed in such a way that it is proximate to the channel wall 118 such that when the worm 110 is rotated it prevents the nut 116 from rotating along with the worm. Additionally, the rotation actuator 100 includes a drive shaft 120 having a left end 122 and a right end 124, attached to the worm 110 such that the left end 122 of the drive shaft 120 is coupled to the right end 114 of the worm 110. Further, the rotation actuator 100 includes a cable 126 having a left portion 128, a right portion 130, and a center portion 132. The center portion 132 is attached to the nut 116 such that the left portion 128 extends out past the left end 106 of the channel 102 and the right portion 130 extending out past the right end 108 of the channel 102.

The actuator depicted in FIG. 1 is designed so that when the worm 110 is rotated in one direction the nut 116 and the center portion 132 of the cable 126 travel towards the left end 112 of the worm 110 and when the worm 110 is rotated the opposite direction, the nut 116 and the center portion 132 of the cable 126 travel towards the right end 114 of the worm 110. The channel 102, worm 110 and nut 116 may all be formed out of any suitable material, including but not limited to, plastic, steel, wood, brass, etc.

Figure 2:
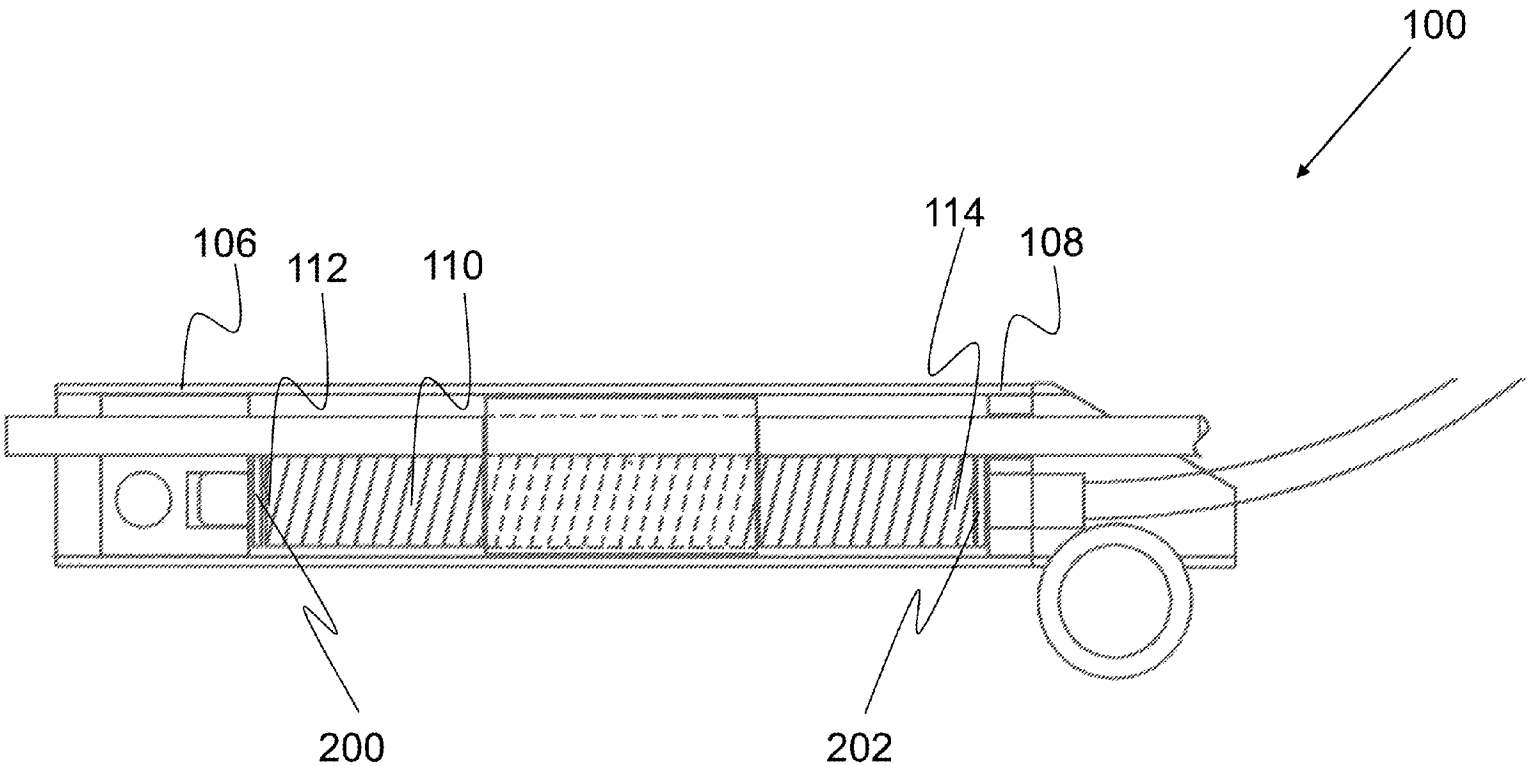
FIG. 2 is a top-view illustration of a rotation actuator incorporated in the snow or debris removal system.

FIG. 2 illustrates a top-view of the rotation actuator in the debris removal system. In this aspect of the system, the actuator 100 further includes a first roller thrust bearing 200 and a second roller thrust bearing 202, wherein the first roller thrust bearing 200 is mounted between the left end 106 of the channel 102 and the left end 112 of the worm 110. The second roller thrust bearing 202 is mounted between the right end 108 of the channel 102 and the right end 114 of the worm 110. Typically, when a roller thrust bearing is used the worm 110 should have a lead angle of 6 degrees to 15.6 degrees with a desired angle of 7 to 9 degrees. In another variation, the rotation actuator 100 can utilize a set of hardened and ground thrust washers in place of the roller thrust bearings 200 and 202. In this situation the worm 110 should have a lead angle of 13 degrees to 19 degrees with a desired angle of 14 to 16 degrees. In either of these configurations, the lead angle is selected so the rotation actuator 100 will provide sufficient torque to the implement but still retain the ability to rotate the implement rapidly.

Figure 3:
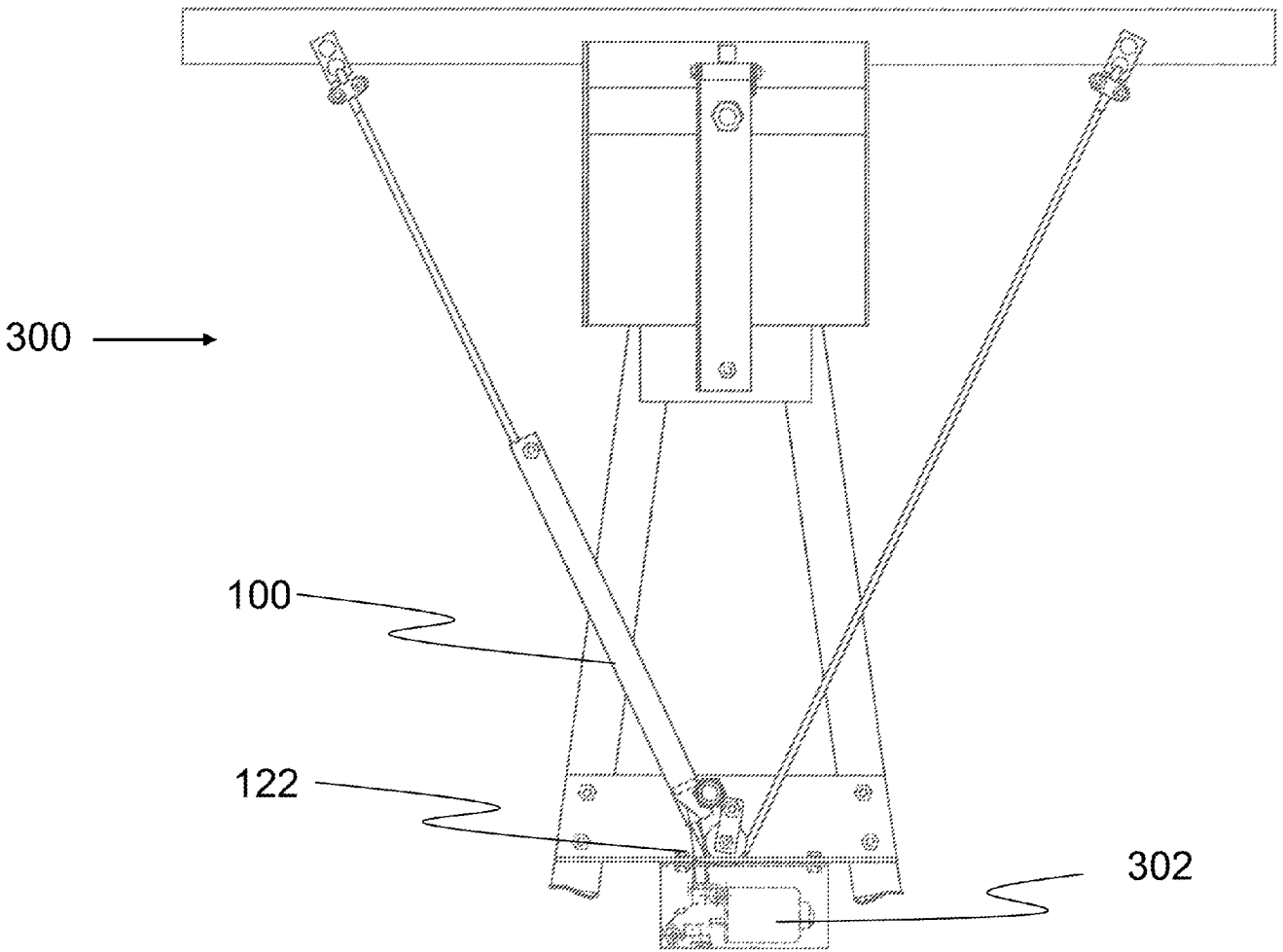
FIG. 3 is a top-view illustration of the snow or debris removal system, depicting the rotation actuator incorporated therein.

FIG. 3 is a top-view illustration of the snow and debris removal system 300. In this aspect, the system 300 includes an electric motor 302; wherein the right end of the drive shaft 122 is coupled to the electric motor 302. In this aspect, the electric motor should be of a type that has leads and resists rotation when both electrical leads are grounded. The drive shaft 122 can be made out of any material that will provide sufficient torque to the rotation actuator 100 and connect the worm 110 with the electric motor 302.

Figure 4:
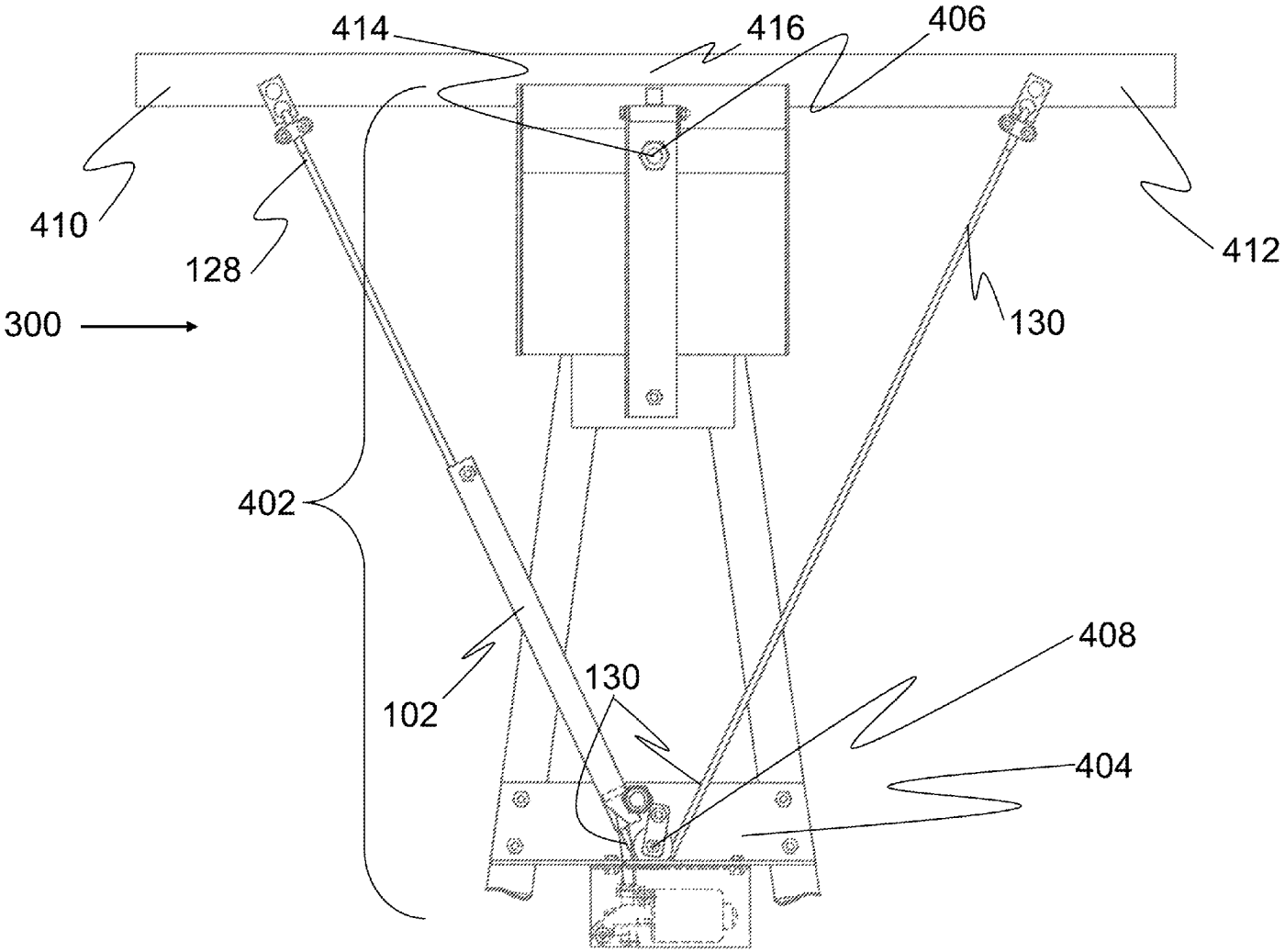
FIG. 4 is a top-view illustration of the snow or debris removal system, depicting the rotation actuator incorporated therein.

FIG. 4 illustrates another aspect of the snow and debris removal system 300. In this aspect, the system 300 includes a frame 402 having a back portion 404 and a front pivot point 406. Additionally, it includes a pulley 408. The pulley 408 is rotationally mounted to the back portion 404 of the frame 402 such that the right portion 130 of the cable (depicted as item 126 in FIG. 1) extends around the pulley 408. The system further includes an implement 416 having a left portion 410, a right portion 412, and an implement pivot point 414. The implement pivot point 414 is rotationally attached to the frame's front pivot point 406. The left portion 128 of the cable (depicted as item 126 in FIG. 1) is attached to the left portion 410 of the implement 416 and the right portion 130 of the cable (depicted as item 126 in FIG. 1) is attached to the right portion 412 of the implement 416. Thus, when the worm (depicted as item 110 in FIG. 1) is rotated one direction the nut (depicted as item 116 in FIG. 1) and center portion of the cable (depicted as item 132 in FIG. 1) are pulled to the left thereby extending the left portion 128 of the cable (depicted as item 126 in FIG. 1) that extends past the left end (depicted as item 106 in FIG. 1) of the channel 102 and retracting the right portion 130 of the cable (depicted as item 126 in FIG. 1) that extends past the right end (depicted as item 108 in FIG. 1) of the channel 102. This causes the implement 416 to rotate about the front pivot point 406 with the left portion 410 of the implement 416 rotating away from the pulley 408 and the right portion 412 of the implement 416 rotating towards the pulley 408. When the worm (depicted as item 110 in FIG. 1) is rotated the opposite direction the left portion 128 of the cable (depicted as item 126 in FIG. 1) that extends past the left end (depicted as item 106 in FIG. 1) of the channel 102 is retracted and the right portion 130 of the cable (depicted as item 126 in FIG. 1) that extends past the right end (depicted as item 108 in FIG. 1) of the channel 102 is extended. This causes the implement 416 to rotate about the front pivot point 406 with the right portion 412 of the implement 416 rotating away from the pulley 408 and the left portion 410 of the implement 416 rotating towards the pulley 408.

The implement 416 mounted to the system could include any device that would benefit from rotational or lift actuation. These devices include but are not limited to plows, rock rakes, box blades, grader blades and hay rakes.

Figure 5:
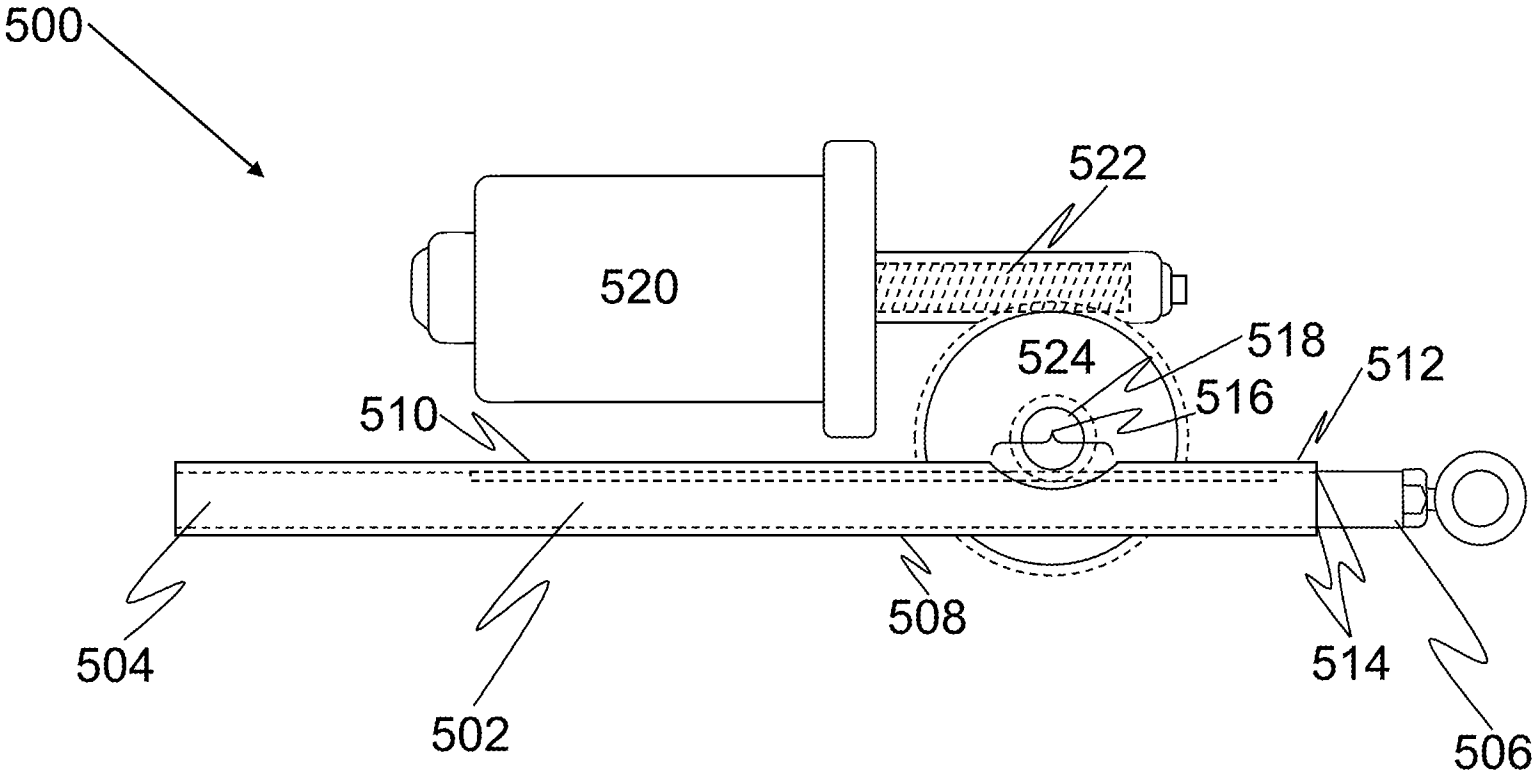
FIG. 5 is a right, side-view illustration of the snow and debris removal system lift actuator.

In another aspect, FIG. 5 provides a right, side-view of the lift actuator 500. This non-limiting example includes a rack having teeth 502, a left end 504 and a right end 506. The lift actuator 500 further includes a case 508 which substantially encloses the rack 502, a side 510 and a right end 512. The rack 502 is shaped such that it may freely slide within the case 508 and the right end 512 of the case 508 and the right end 506 of the rack 502 are proximate to each other. The case further comprises an opening on the right end 514 of the case 508 and an opening 516 on the side 510 of the case 508. Additionally, a pinion 518 is rotationally mounted to the case proximate to the opening 516 on the side 510 of the case 508 such that the pinion 518 engages the teeth of the rack 502. A motor actuator 520 is attached to the case 508 and coupled to a worm 522. The worm 522 is mounted such that it engages a worm gear 524. The worm gear 524 in turn is rotationally coupled to the pinion 518. The motor 520 unidirectional, in that it can not be back driven. Thus, when the motor actuator 520 rotates in a given direction it turns the worm 522 which rotates the worm gear 524. This rotates the pinion 518 which is engaged to the rack 502 thereby sliding the rack 502 within the case 508 which either extends or retracts the right end 506 of the rack 502 relative to the case 508.

Figure 6:
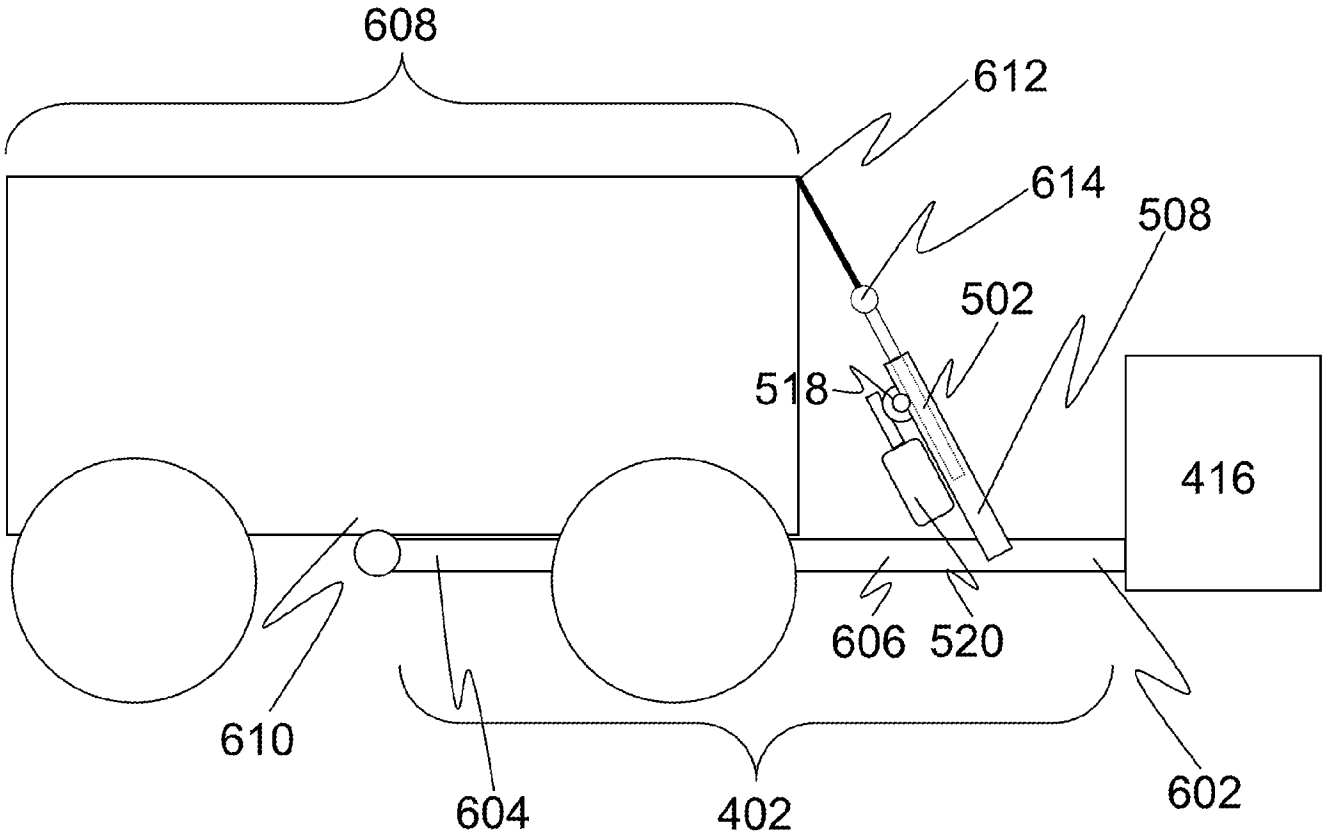
FIG. 6 is a right, side-view illustration of the snow and debris removal system, depicting the lift actuator incorporated therein.

FIG. 6 uses a right, side-view to illustrate another aspect of the snow and debris removal system. In this non-limiting example, a frame 402 is attached to the case 508. The frame 402 has a front portion 602, a rear portion 604 and a center portion 606 such that the case 508 is attached to the center portion 606 of the frame 402. The implement 416 is mounted on the front portion 602 of the frame 402. The system further includes an implement mounting device 608 having a bottom portion 610 and a fixed point 612. The bottom portion 610 of the implement mounting device 608 is hingedly attached to the rear portion 604 of the frame 402. Additionally, a lift point 614 is attached to the rack 502. Finally, the lift point 614 is attached to the fixed point 612 of the implement mounting device 608. Thus, when the motor 520 rotates one direction, it turns the pinion 518 which causes the rack 502 to extend out of the case 508 and moves the implement 416 away from the fixed point 612. Alternatively, when the motor 520 rotates the opposite direction, it turns the pinion 518 which causes the rack 502 to retract into the case 508 and moves the implement 416 towards the fixed point 612.

The connection between the lift actuator 500 and the fixed point 612 can include any connection system capable of withstanding the loads that will be imposed on the system and is suitable for the required function. Connectors include but are not limited to, ropes, cables, push/pull rods, and fasteners. Further, the method of mounting the implement 416 to the implement mounting device 608 can be any method that maintains the implement 416 in a suitable position relative to the implement mounting device 608 and allows for the lift actuator 500 to lift or lower the implement 416 relative to the implement mounting device 608. As can be appreciated by one skilled in the art, the case 508 of the lift actuator 500 could alternatively be attached to the fixed point 612 and the lift point 614 could be attached to either the frame 402 or the implement 416.

Figure 7:
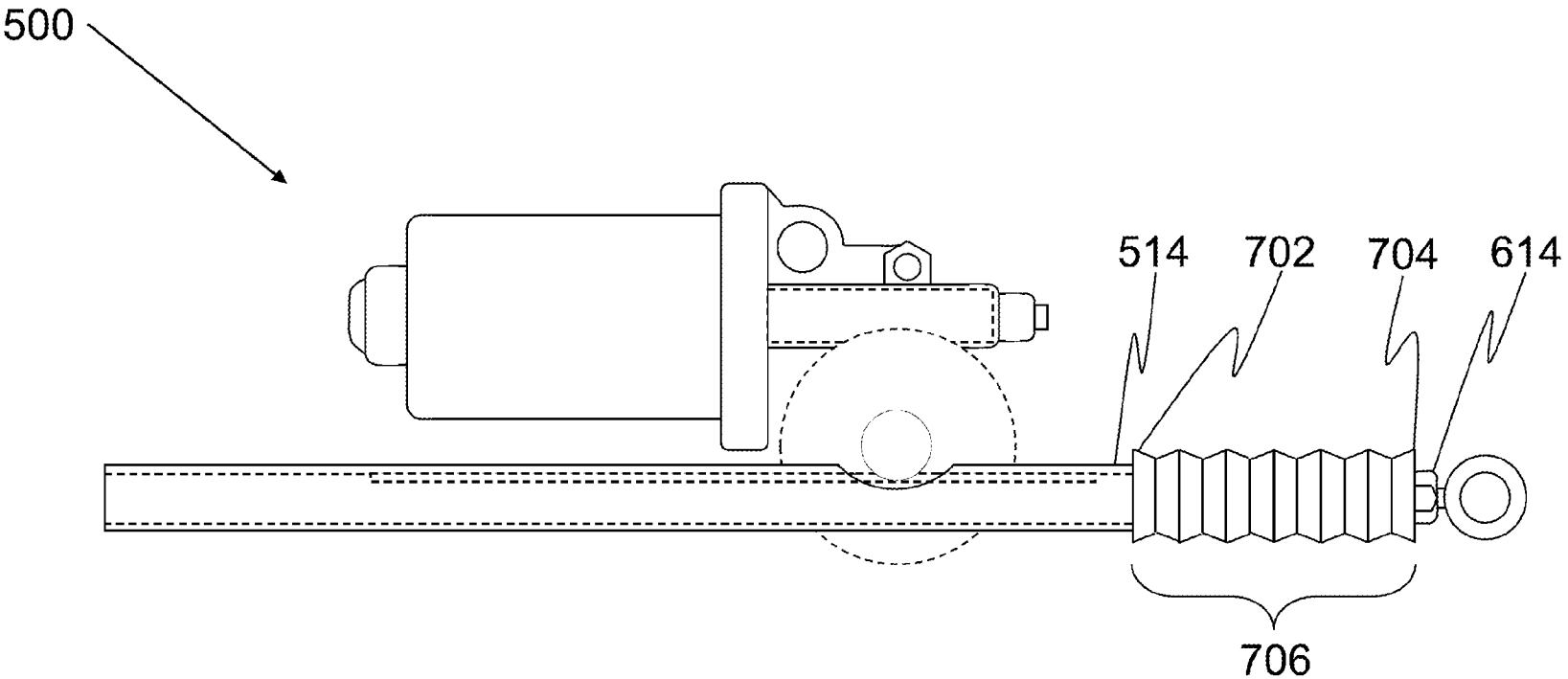
FIG. 7 is an illustration of an aspect of the snow and debris removal system lift actuator.

FIG. 7 illustrates another aspect of the lift. FIG. 7 depicts the lift actuator 500 but with the addition of a protective cover 706 having a first portion 702 and a second portion 704. The first portion 702 of the protective cover 706 is attached proximate to the opening on the right end 514 of the case (depicted as item 508 in FIG. 5) and the second portion 704 of the protective cover 706 is attached proximate to the lift point 614.

Figure 8:
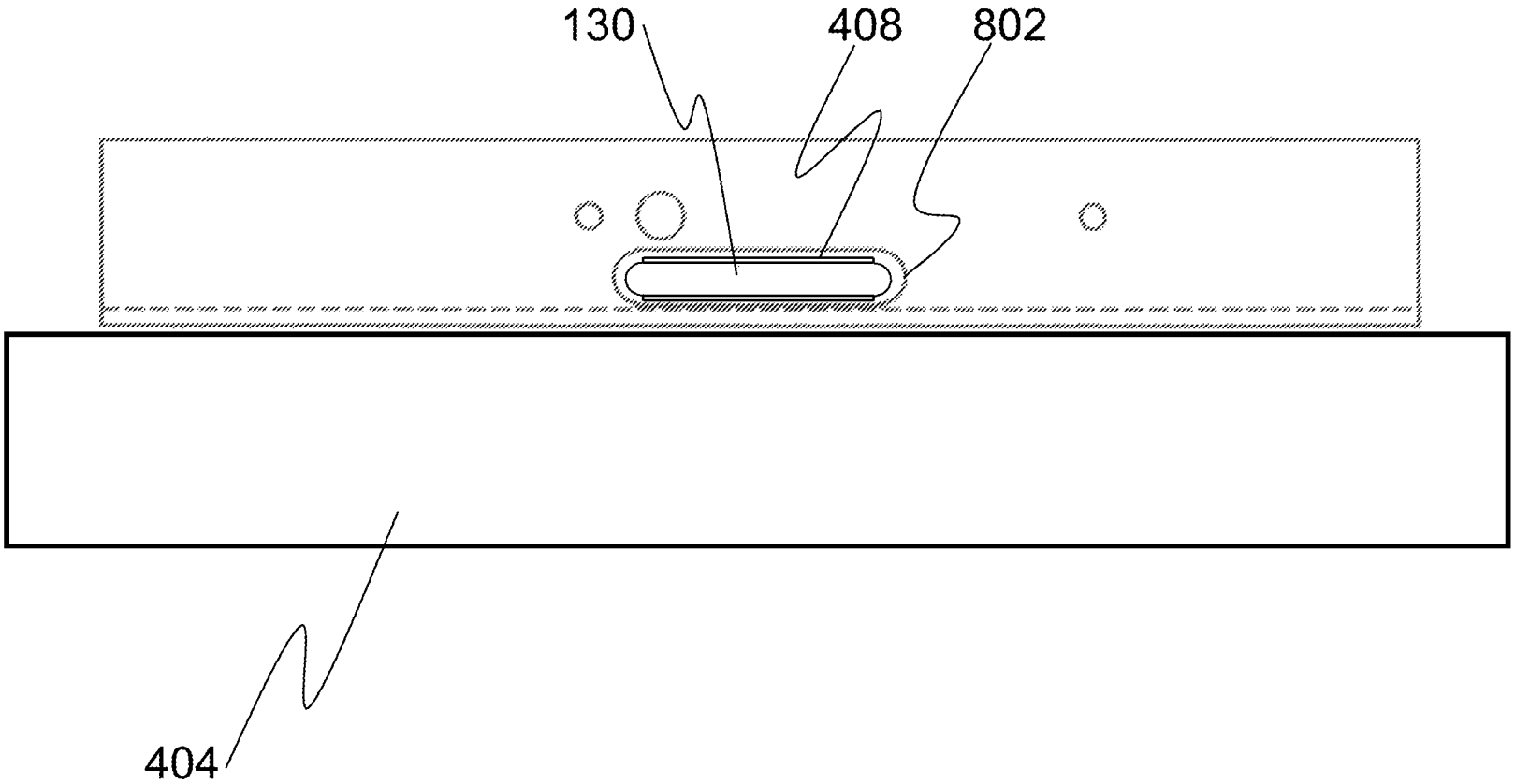
FIG. 8 is a back-view illustration of the snow and debris removal system.

FIG. 8 illustrates yet another aspect of the snow and debris removal system. This non-limiting example depicts the rear portion of the frame 404 and a pulley mounting slot 802. The pulley 408 is rotationally mounted within the pulley mounting slot 802. The right side 130 of the cable (depicted as item 126 in FIG. 1) extends from the nut (depicted as item 116 in FIG. 1) around the pulley 408 and finally connects to the right side of the implement (depicted as item 412 in FIG. 4). It should be noted that the height of the pulley mounting slot 802 and the width of the right side 130 of the cable (depicted as item 126 in FIG. 1) are substantially similar. As can be appreciated by one skilled in the art, by having the pulley mounting slot 802 and the right side 130 of the cable (depicted as item 126 in FIG. 1) similar in size it prevents the cable from "jumping" off the pulley and thereby causing the rotational actuator (depicted item 100 in FIG. 1) to jam.

What is claimed is:

1. An implement position actuator, comprising:

a rotationally mounted worm having threads;

a nut having internal threads, threadedly engaging the worm threads;

a cable attached to the nut;

a motor attached to the worm; and the nut exterior formed in a way that prevents the nut from rotating when the worm is rotated but allows the nut to travel up and down the worm thereby moving the cable attached to the nut;

wherein the worm is rotationally mounted within a channel; and wherein the exterior of the nut is formed to be proximate to an interior of the channel, such that the interior of the channel engages with the exterior of the nut in a way that prevents the nut from rotating when the worm is rotated.

2. An implement position actuator as set forth in claim 1, wherein the channel substantially encloses the worm and nut.

3. An implement position actuator as set forth in claim 1, wherein the motor attached to the worm is connected to the worm by means of a driveshaft.

4. An implement position actuator as set forth in claim 3, wherein the driveshaft is flexible.

5. An implement position actuator as set forth in claim 1, wherein the motor is an electric motor having electrical leads that resists rotation when both electrical leads are grounded.

6. An implement position actuator as set forth in claim 1, further comprising a first roller thrust bearing and a second roller thrust bearing, wherein the first roller thrust bearing is mounted proximate to one end of the worm and the second roller thrust bearing is mounted proximate to the second end of the worm.

7. An implement position actuator as set forth in claim 6, wherein the worm has a lead angle of 6 to 15.6 degrees.

8. An implement position actuator as set forth in claim 1, further comprising a first hardened and ground thrust washer and a second hardened and ground thrust washer, wherein the first hardened and ground thrust washer is mounted proximate to one end of the worm and the second hardened and ground thrust washer is mounted proximate to the second end of the worm.

9. An implement position actuator as set forth in claim 8, wherein the worm has a lead angle of 13 to 19 degrees.

10. An implement position actuator as set forth in claim 1, further comprising a frame and a pivot point;

the cable further comprises a first end extending from the nut and a second end extending from the nut;

a pulley, wherein the pulley is rotationally mounted to the frame and a portion of the cable extends around the pulley;

an implement having an implement pivot point and a first and second portions, wherein the implement pivot point is rotationally attached to the frame pivot point, wherein the first and second portions are on opposite sides of the rotational axis of the implement pivot point, wherein the first end of the cable is attached to the first portion of the implement and the second end of the cable is attached to the second portion of the implement, whereby when the worm is rotated one direction the nut moves up or down the worm and the cable is moved thereby extending one end of the cable and retracting the other end of the cable, which causes the implement to rotate about the implement pivot point with one portion of the implement rotating away from the pulley and the other portion of the implement rotating towards the pulley.

11. An implement position actuator as set fourth in claim 10, wherein the rotational axis of the pulley is parallel to the rotational axis of the implement pivot point.

12. An implement position actuator as set forth in claim 11, wherein the frame further comprises a pulley mounting slot, where the pulley is rotationally mounted in the pulley mounting slot.

13. An implement position actuator as set forth in claim 12, wherein the cable and the pulley form a pulley and cable width, and the pulley mounting slot has a width, and the width of the pulley mounting slot is substantially similar to the pulley and cable width.

14. An implement position actuator as set forth in claim 10, wherein the implement is of a type selected from the group consisting of a plow, rock rake, box blade, grader blade, and hay rake.

15. An implement position actuator, comprising:

a rotationally mounted worm having threads;

a nut having internal threads, threadedly engaging the worm threads;

a cable attached to the nut;

a motor attached to the worm;

the nut exterior formed in a way that prevents the nut from rotating when the worm is rotated but allows the nut to travel up and down the worm thereby moving the cable attached to the nut;

wherein the worm is rotationally mounted within a channel;

wherein the channel substantially encloses the worm and nut;

wherein the interior of the channel engages with the exterior of the nut in a way that prevents the nut from rotating when the worm is rotated;

wherein the motor attached to the worm is connected to the worm by means of a driveshaft;

wherein the driveshaft is flexible;

wherein the motor is an electric motor having electrical leads that resists rotation when both electrical leads are grounded;

a frame and a pivot point;

wherein the cable further comprises a first end extending from the nut and a second end extending from the nut;

a pulley, wherein the pulley is rotationally mounted to the frame and a portion of the cable extends around the pulley;

an implement having an implement pivot point and a first and second portions;

wherein the implement pivot point is rotationally attached to the frame pivot point;

wherein the first and second portions are on opposite sides of the rotational axis of the implement pivot point;

wherein the first end of the cable is attached to the first portion of the implement and the second end of the cable is attached to the second portion of the implement, whereby when the worm is rotated one direction the nut moves up or down the worm and the cable is moved thereby extending one end of the cable and retracting the other end of the cable, which causes the implement to rotate about the implement pivot point with one portion of the implement rotating away from the pulley and the other portion of the implement rotating towards the pulley;

wherein the rotational axis of the pulley is parallel to the rotational axis of the implement pivot point;

wherein the frame further comprises a pulley mounting slot, where the pulley is rotationally mounted in the pulley mounting slot;

wherein the cable and the pulley form a pulley and cable width, and the pulley mounting slot has a width, and the width of the pulley mounting slot is substantially similar to the pulley and cable width; and wherein the implement is of a type selected from the group consisting of a plow, rock rake, box blade, grader blade, and hay rake.

16. An implement position actuator, comprising:

a rotationally mounted worm having threads;

a nut having internal threads, threadedly engaging the worm threads;

a cable attached to the nut;

a motor attached to the worm;

the nut exterior formed in a way that prevents the nut from rotating when the worm is rotated but allows the nut to travel up and down the worm thereby moving the cable attached to the nut;

wherein the worm is rotationally mounted within a channel;

wherein the channel substantially encloses the worm and nut;

wherein the interior of the channel engages with the exterior of the nut in a way that prevents the nut from rotating when the worm is rotated;

wherein the motor attached to the worm is connected to the worm by means of a driveshaft;

wherein the driveshaft is flexible;

wherein the motor is an electric motor having electrical leads that resists rotation when both electrical leads are grounded;

a frame and a pivot point;

wherein the cable further comprises a first end extending from the nut and a second end extending from the nut;

a pulley, wherein the pulley is rotationally mounted to the frame and a portion of the cable extends around the pulley;

an implement having an implement pivot point and a first and second portions;

wherein the implement pivot point is rotationally attached to the frame pivot point;

wherein the first and second portions are on opposite sides of the rotational axis of the implement pivot point;

wherein the first end of the cable is attached to the first portion of the implement and the second end of the cable is attached to the second portion of the implement, whereby when the worm is rotated one direction the nut moves up or down the worm and the cable is moved thereby extending one end of the cable and retracting the other end of the cable, which causes the implement to rotate about the implement pivot point with one portion of the implement rotating away from the pulley and the other portion of the implement rotating towards the pulley;

wherein the rotational axis of the pulley is parallel to the rotational axis of the implement pivot point;

wherein the frame further comprises a pulley mounting slot, where the pulley is rotationally mounted in the pulley mounting slot;

wherein the cable and the pulley form a pulley and cable width, and the pulley mounting slot has a width, and the width of the pulley mounting slot is substantially similar to the pulley and cable width; and wherein the implement is a plow.

* * * * *